US006335712B1

(12) United States Patent
Kim

(10) Patent No.: US 6,335,712 B1
(45) Date of Patent: Jan. 1, 2002

(54) METHOD OF DRIVING PLASMA DISPLAY PANEL

(75) Inventor: Gap Sick Kim, Kyungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/394,432

(22) Filed: Sep. 13, 1999

(30) Foreign Application Priority Data

Sep. 11, 1998 (KR) ..... 98-37604

(51) Int. Cl.[7] ..... G09G 3/28
(52) U.S. Cl. ..... 345/60; 345/68; 315/169.4
(58) Field of Search ..... 345/60, 62, 66, 345/68, 208–210, 63; 315/169.4, 169.1

(56) References Cited

U.S. PATENT DOCUMENTS

| | | | | |
|---|---|---|---|---|
| 5,446,344 A | * | 8/1995 | Kanazawa | 315/169.4 |
| 6,020,687 A | * | 2/2000 | Hirakawa et al. | 345/60 |
| 6,023,258 A | * | 2/2000 | Kuriyama et al. | 345/60 |

FOREIGN PATENT DOCUMENTS

| | | |
|---|---|---|
| JP | 61-205993 | 9/1986 |
| JP | 62-196691 | 8/1987 |
| JP | 3-175491 | 7/1991 |
| JP | 6-310040 | 11/1994 |
| JP | 10-171399 | 6/1998 |
| JP | 60-208180 | 10/1998 |
| JP | 10-312755 | 11/1998 |
| JP | 11-065514 | 3/1999 |
| JP | 11-109914 | 4/1999 |
| JP | 11-143422 | 5/1999 |
| JP | 11-202830 | 7/1999 |
| JP | 11-311975 | 11/1999 |
| KR | 00-31114 | 9/2000 |

* cited by examiner

*Primary Examiner*—Regina Liang
(74) *Attorney, Agent, or Firm*—Fleshner & Kim, LLP

(57) ABSTRACT

A plasma display panel driving method that is adaptive for a high-speed drive and capable of improving the contrast. In the method, pixel cells at the arbitrarily or optionally selected lines in the entire pixel cells are writing-discharged. The specified pixel cells in the writing-discharged pixel cells are address-discharged to select the specified pixels. A discharge of the specified pixel cells is sustained by a sustaining discharge pulse, and a discharge of the pixel cells except for the specified pixel cells is self-erased.

11 Claims, 5 Drawing Sheets

METHOD OF DRIVING PLASMA DISPLAY PANEL

BACKGROUND OF THE INVENTION

1. Field of the Invention

This invention relates to a driving method for a plasma display panel, and more particularly to a plasma display panel driving method that is adaptive for a high speed drive and is capable of improving the contrast.

2. Description of the Related Art

Recently, a plasma display panel(PDP) feasible to the fabrication of large-scale panel has been available for a flat panel display device. The PDP controls a discharge interval of each pixel to display a picture. As shown in FIG. 1, such a PDP typically includes a PDP of alternating current (AC) system having three electrodes and driven with an AC voltage.

FIG. 1 shows the conventional AC system PDP having discharge cells arranged in a matrix pattern. Each pixel of the AC system PDP includes an upper plate having a scanning electrode 12A, a sustaining electrode 12B, an upper dielectric layer 14 and a protective film 16 disposed on the upper substrate 10, and a lower plate having an address electrode 20, a lower dielectric layer 22, a barrier rib 24 and a fluorescent layer 26 disposed on a lower substrate 18. The upper substrate 10 and the lower substrate 18 are spaced, in parallel, by the barrier rib 24. The scanning electrode 12A and the sustaining electrode 12B are formed, in parallel, on the upper substrate 10. Wall charges produced during the plasma discharge are accumulated on the upper dielectric layer 14 and the lower dielectric layer 22. The protective film 16 prevents a damage of the upper dielectric layer 14 due to the sputtering, thereby prolonging a life of PDP as well as improving an emissive efficiency of secondary electrons. Usually, MgO is used as the protective film 16. The address electrode 20 is crossed with the scanning electrode 12A an d the sustaining electrode 12n. A data signal is applied to the address electrode 20. The barrier rib 24 is formed in parallel to the address electrode 20. The barrier 24 prevents an ultraviolet ray and a visible light produced by the discharge from being leaked into the adjacent cells. The fluorescent layer 26 is coated on the surfaces of the lower dielectric layer 22 and the barrier rib 24 to generate any one of red, green and blue visible lights. An inactive gas for a gas discharge is injected into a discharge space between the upper or lower plate and the barrier rib.

Referring to FIG. 2, a driving apparatus for the AC system PDP) includes a PDP 30 arranged in a matrix pattern in such a manner that mxn pixel cells are connected to scanning electrode lines Y1 to Ym, sustaining electrode lines Z1 to Zm and address electrode lines X1 to Xn, a scanning electrode driver 32 for driving the scanning electrode lines Y1 to Ym, a sustaining electrode driver 34 for driving the sustaining electrode lines Z1 to Zm, and first and second address electrode drivers 36A and 36B for divisionally driving odd-numbered address electrode lines X1, X3, . . . , Xn−3, Xn−1 and even-numbered address electrode lines X2, X4, . . . , Xn−2, Xn. The scanning electrode driver 32 applies a scanning pulse and a sustaining pulse to the scanning electrode lines Y1 to Ym sequentially, thereby allowing the pixel cells 1 to be sequentially scanned in a line unit and allowing a discharge at each of the mxn pixel cells to be sustained. The sustaining electrode driver 34 applies a sustaining pulse to all the sustaining electrode lines Z1 to Zn. The first and second address electrode drivers 36A and 36B supply an image data to the address electrode lines X1 to Xn in such a manner to be synchronized with the scanning pulse. The first address electrode driver 36A supplies an image data to the odd-numbered address electrode lines X1, X3, . . . , Xn−3, Xn−1 while the second address electrode driver 36B supplies an image data to the even-numbered address electrodes X2, X4, . . . , Xn−2, Xn.

Such an AC system PDP implements the gray level by controlling a light quantity depending on a discharge time. in other words, the AC system PDP controls a discharge time to make the contrast and the chrominance of a picture different. To this end, the AC system PDP mainly uses a driving system such as an addressing display separated (ADS) system. The ADS system divides one frame into a number of sub-fields, each of which is divided into an address interval and a sustaining interval different from each other, in accordance with a gray level to be implemented. For instance, when it is intended to display a picture with 256 gray levels, a frame interval corresponding to 1/60 second is divided into 8 sub-fields SF1 to SF8. Further, each of the 8 sub-fields SF1 to SF8 is again divided into an address interval and a sustaining interval.

FIG. 3 shows drive waveforms of the AC system PDP. In FIG. 3, a writing pulse WP is applied to the address electrode line X in an address interval, whereas a scanning pulse—SCP and a sustaining pulse SUSP are applied to the scanning electrode line Y in an address interval and in a sustaining interval, respectively. Also, the sustaining pulse SUSP is applied to the sustaining electrode line Z in a sustaining interval. In the address interval, an address discharge is generated between the address electrode line X and the scanning electrode line Y at a time t1 when the writing pulse WP begins to be applied. At this time, a desired level of direct current voltage is applied to the sustaining electrode lines Z. This direct current voltage permits an address discharge between the address electrode line X and the scanning electrode line Y to be generated stabbly. By the address discharge, wall charges are accumulated on the dielectric layer 14 within the discharge space at a time t2. The writing pulse WP has a pulse width more than about 3 $\mu$s to sustain the discharge during a time allowing a formation of the wall charges. Subsequently, a sustaining interval begins at a time t3. At the time t3, a sustaining discharge is generated between the scanning electrode line Y and the sustaining electrode line Z from the sustaining pulse SUSP applied to the scanning electrode line Y. At a time t4 when the sustaining pulse SUSP remains at a high level, wall charges are accumulated on the dielectric layer 14. The wall charges make a memory effect allowing an electric field within the discharge space to be sustained. In other words, the sustaining discharge is generated from an electric field formed by the wall charges and an electric field formed by the sustaining pulse SUSP. Accordingly, any discharge is not generated within the pixel cell 1 in which wall charges are not formed even when the sustaining pulse SUSP is applied. At a time when the sustaining pulse SUSP applied to the scanning electrode line Y changes into a low level and, at the same time, the sustaining pulse SUSP begins to be applied to the sustaining electrode line Z, a sustaining discharge is again generated between the scanning electrode line Y and the sustaining electrode line Z. At a time t6, wall charges are formed As described above, the sustaining discharge and the formation of wall charges are continuously provided by the sustaining pulse SUSP applied to the scanning electrode line Y and the sustaining electrode line Z alternately to thereby sustain a discharge of the pixel cells 1 selected by the address discharge. After the sustaining interval, an erasing pulse EP is applied to the scanning electrode line Y between t7 and t8 within an erasing interval. A voltage level of the erasing pulse EP is set to have a lower value than that of the sustaining pulse SUSP, and a pulse width thereof is set to have a narrower value (i.e., about 1 μs) than that of the sustaining pulse SUSP. By this erasing pulse EP, a discharge is generated between the scanning electrode line Y and the sustaining electrode line Z. Since a pulse width of the erasing pulse is set to be shorter than a time allowing a formation of the wall charges, a discharge does not occur even though a sustaining pulse is applied later. Accordingly, the sustaining discharge is erased by the erasing pulse EP.

Such a PDP driving system is classified into a selective writing system and a selective erasing system depending on whether or not the pixel cell 1 supplied with the writing pulse WP is luminous. The selective writing system causes a sustaining discharge and a erasure discharge continuously at the corresponding pixel cell 1 after turning on the pixel cell 1 supplied with the writing pulse WP in the address interval. The selective writing system requires a reset discharge for initializing a full field prior to the address discharge or the writing discharge so as to uniform an electric field within all the pixel cells because the pixel cell 1 in which a discharge has been generated at the previous frame and the pixel cell 1 in which a discharge has not been generated thereat coexist. However, the selective writing system has a problem in that, since a width of the writing pulse WP applied to the address electrode lines X must be at least 3 μs so as to form wall charges sufficiently as mentioned above, an address interval including a scanning interval as a non-display interval is lengthened. In other words, since each scanning electrode line Y requires a scanning interval more than 3 μs, a sustaining interval as a display interval is shortened to that extent, Moreover, since a data amount increases as a resolution of the PDP becomes high, a scanning interval is lengthened within the limited frame interval and, therefore, a sustaining interval exerting an influence upon the brightness is shortened to that extent. In consideration of red(R), green(G), and blue(B) sub-pixel cells at a 1024×1024 resolution, 256 gray scales (8 bits) and a frame frequency of 60 Hz, a data amount to be processed is 1.75 Gbits (i.e., 1024×1280×3 ×8×60 bits) per second, 30 Mbits (i.e., 1024×1280×3 ×8 bits) per frame (e.g., 16.67 ms in the case of an image signal of NTSC system), and 30 Kbits (i.e., 1280×3×8 bits) per address electrode line. A data amount to be processed is proportionally increased as the resolution becomes high. There has been suggested a scheme that uses a drive circuit for dividing a field into a number of blocks and driving each block, considering that the full data can not be processed within the limited time as described above. Since the block driving system requires a great number of drive circuits, however, it causes a cost rise.

Otherwise, the selective erasing system turns off the pixel cells 1 having a video data of "0" in the address interval after turning on all the pixel cells 1. At this time, the remaining pixel cells that have not been turned off maintain a discharge by the sustaining discharge. Accordingly, it is necessary for all the pixel cells 1 to be turned on every sub-field by the writing discharge. In a state of turning on all the pixel cells 1, the pixel cells 1 having a video data of "0" are turned off by the erasure discharge. A pulse width for causing the erasure discharge is about 1 μs. Accordingly, the selective erasing system permits a high speed driving, and thus is adaptive for a high resolution having a large quantity of data to be processed. Since the selective erasing system turns off only the pixel cells 1 having a video data of "0" after turning on all the pixel cells 1 every frame by the writing discharge, however, a writing discharge of all the pixel cells 1 must be stable upon initialization of the full field. In other words, all the pixel cells 1 turned on by the writing discharge upon initialization of the full field must have the same wall charge quantity or electric field, but the quantity of the wall charge or electric field accumulated on all the pixel cells 1 may be different from each other in accordance with a discharge deviation of the previous frame or the previous sub-field. In this case, even when an erasing pulse is applied to the pixel cells 1 having a video data of "0" in the address interval, a non-stable state that is able to keep a turned-on state or unable to keep a turned-on state is sustained. In order to solve such a problem, there has been suggested a scheme that applies a pulse signal for stabilizing the writing discharge as shown in FIG. 4. Referring to FIG. 4, after a negative writing pulse −WP was applied to the selected scanning electrode lines Y for the writing discharge of the corresponding lines, a positive stabilization-sustaining pulse STSUSP and a negative erasure-scanning pulse −ESP ale sequentially applied thereto. A positive writing pulse WP and a negative stabilization-sustaining pulse −STSUSP synchronized with the writing pulse −WP and the stabilization-sustaining pulse STSUSP applied to the scanning electrode line Y, respectively are sequentially applied to the sustaining electrode line Z. A positive address pulse AP is applied to the address electrode line X in such a manner to be synchronized with the erasure-scanning pulse −ESP.

First, writing pulses WP and −WP are simultaneously applied to the scanning electrode lines Y and the sustaining electrode lines Z corresponding to the selected lines. At this time, the corresponding pixel cells 1 generates a writing discharge by a voltage difference 2WP between the scanning electrode lines Y and the sustaining electrode lines Z. During the writing discharge, wall charges are produced within the discharge space of the pixel cells 1. Positive wall charges are accumulated on the dielectric layer 14 disposed on the scanning electrode lines Y while negative wall charges are accumulated on the dielectric layer 14 disposed on the sustaining electrode lines Z, depending on the polarity of the writing pulses WP and −WP applied to the scanning electrode lines Y and the sustaining electrode lines Z. By this writing discharge, the pixel cells 1 connected to the scanning electrode lines Y and the sustaining electrode lines Z supplied with the writing pulses WP and −WP are turned on to be luminous.

Subsequently, the stabilization-sustaining pulse STSUSP and −STSUSP are simultaneously applied to the selected scanning electrode lines Y and sustaining electrode lines Z. The stabilization-sustaining pulse STSUSP and −STSUSP allow the same quantity of wall charge or electric field to be formed at the pixel cells 1 by the discharge. In other words, the writing discharge of the pixel cells 1 selected in accordance with a discharge state of the previous frame or the previous sub-field is generated non-uniformly. In this case, the wall charge quantity and the electric field produced for each pixel cells 1 may be different from each other. The stabilization sustaining pulses STSUSP and −STSUSP discharge the pixel cells 1 to stabilize a non-stable discharge state during the writing discharge. More specifically, when the stabilization-sustaining pulses STSUSP and −STSUSP are applied to the scanning electrode lines Y and the sustaining electrode lines Z, a voltage caused by wall charges and charged particles produced during the discharge is added to a voltage caused by the stabilization-sustaining pulses STSUSP and −STSUSP at each pixel cell 1. Accordingly, a discharge is generated at the scanning electrode lines Y and the sustaining electrode lines Z by a voltage difference 2STSUSP between the stabilization-sustaining pulses STSUSP and −STSUSP having a lower level than a discharge initiation voltage. By this discharge, the writing discharge for the pixel cells 1 is stabilized and the same level of wall charges are produced Within the selected pixel cells 1. In this case, negative wall charges are accumulated in the scanning electrode line Y side while positive wall charges are accumulated in the sustaining electrode line Z side.

After the stabilization-sustaining discharge, a positive address pulse AP is applied to the address electrode line X connected to the pixel cells having a video data of "0". At the same time, a erasure-scanning pulse −ESP is applied to the scanning electrode lines Y connected to the corresponding pixel cells 1 in such a manner to be synchronized with the address pulse AP. As a result, the pixel cells having a video data of "0" are turned on after an erasure discharge. In other words, since a sum of a voltage caused by wall charges and charged particles formed within the corresponding pixel cells 1 in advance and a voltage formed by the two pulses AP and ESP is lower than the discharge sustaining level, a luminescence is stopped after a slight erasure discharge was generated within the corresponding pixel cells 1. On the other hand, the pixel cells 1 to which the address pulse AP and the erasure scanning pulse −ESP are not applied, sustains a discharge to continue the luminescence.

In FIG. 4, ON represents a voltage level variation of the pixel cells 1 sustaining the luminescence, and OFF does a voltage level variation of the pixel cells 1 turned off during the address discharge. Also, the light power represents of a luminous level of the pixel cells 1 during the writing discharge, the stabilization-sustaining discharge and the erasure discharge.

As seen from the light power, twice discharge is generated in a non-display interval every sub-field because the pixel cells 1 are luminous during the writing discharge and the sustaining discharge. If the writing discharge and the stabilization-sustaining discharge are generated prior to the sustaining discharge as mentioned above, then the contrast becomes poor. In other words, the writing discharge and the stabilization-sustaining discharge are not required for a gray level implementation and raises a black brightness level having a data input of "0", thereby deteriorating the contrast. Specifically, the pixel cells 1 that must keep an off state become luminous in a non-display interval due to the reset discharge and the writing discharge, thereby decreasing a difference between the white peak and the black brightness level to that extent.

SUMMARY OF THE INVENTION

Accordingly, it is an object of the present invention to provide a PDP driving method that is adaptive for a high-speed drive.

Further object of the present invention is to provide a PDP driving method that is capable of improving the contrast.

In order to achieve these and other objects of the invention, a plasma display panel driving method according to an embodiment of the present invention includes providing a writing discharge for pixel cells at the arbitrarily or optionally selected lines in the pixel cells; providing an address discharge for the specified pixel cells in the writing-discharged pixel cells to select the specified pixels; and sustaining a discharge of the specified pixel cells by a sustaining discharge pulse and self-erasing a discharge of the pixel cells except for the specified pixel cells.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 5:
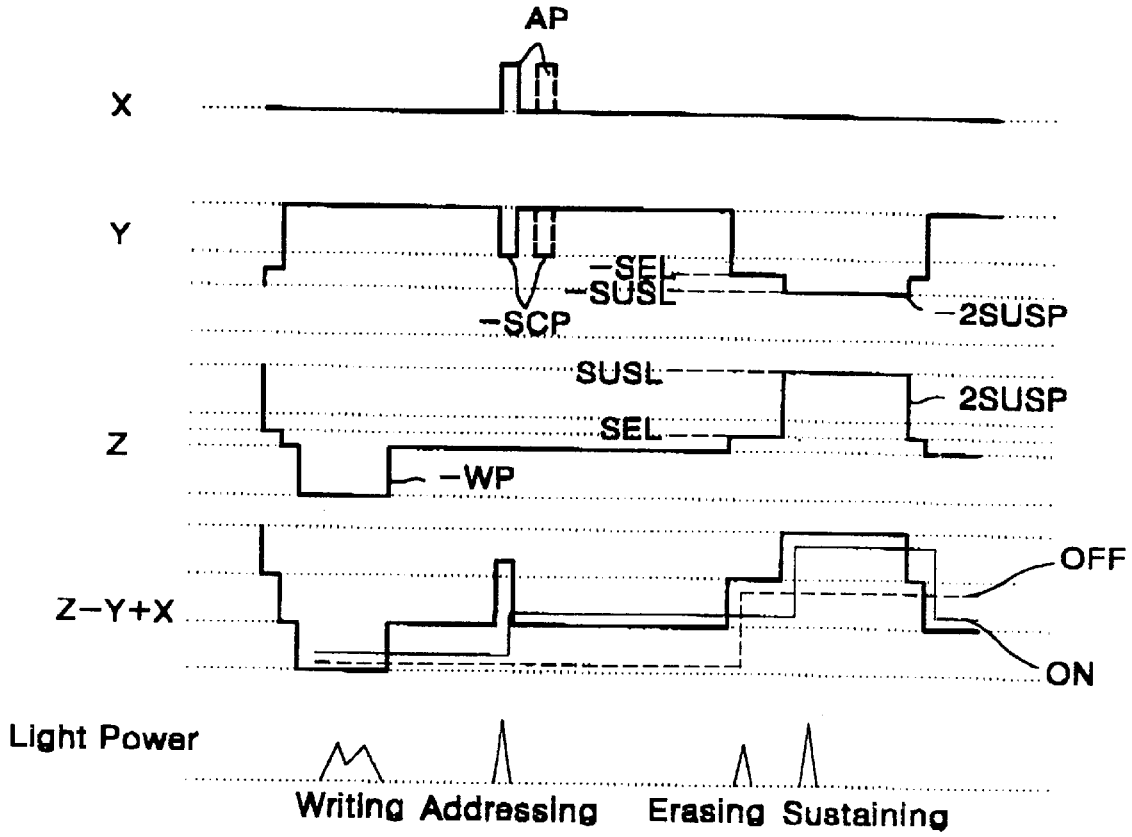
FIG. 5 is drive waveform diagrams for explaining a PDP driving method according to an embodiment of the present invention.

Referring to FIG. 5, in a PDP driving method according to an embodiment of the present invention, a negative scanning pulse −SCP and a two-step sustaining pulse −2SUSP are sequentially applied after a positive direct current voltage was applied to scanning electrode lines Y. After a negative writing pulse −WP for turning on pixel cells 1 in the full field was applied to sustaining electrode lines Z, a positive two-step sustaining pulse 2SUSP synchronized with a two-step sustaining pulse −2SUSP applied to the scanning electrode lines Y is applied. Further, a positive address pulse AP is applied to address electrode lines X in such a manner to be synchronized with the scanning pulse −SCP.

First, a desired level of positive direct current voltage is applied to the scanning electrode lines Y corresponding to the selected scanning lines, and a negative writing pulse −WP is applied to the sustaining electrode lines Z. The pixel cells 1 generates a writing discharge by a voltage difference between the scanning electrode lines Y and the sustaining electrode lines Z. Wall charges produced during the writing discharge becomes such an amount that can cause a self erasure discharge as mentioned later. Negative wall charges are accumulated in the scanning electrode lines Y while positive wall charges are accumulated on the sustaining electrode lines Z. By this writing discharge, the pixel cells 1 are turned on to be luminous.

Subsequently, a positive address pulse AP is applied to the address electrode lines X connected to the pixel cells 1 having a video data of "1", that is, turned on. At the same time, a negative scanning pulse −SCP synchronized with the address pulse AP arid having a pulse width less than 1 $\mu$s is applied to the scanning electrode lines Y connected to the corresponding pixel cells 1, As a result, pixel cells having a video data of "1" generate an address discharge. A voltage within the corresponding pixel cells 1 is heightened as a voltage caused by wall charges and charged particles produced by the discharge is added to a voltage generated by the two pulse AP and −SCP. At this time, a voltage level of the corresponding pixel cells 1 is controlled into a wall voltage level capable of sustaining the discharge, that is, into a sustaining voltage level.

After the address discharge, a negative two-step sustaining pulse −2SUSP is applied to the scanning electrode lines Y, and a positive two-step sustaining pulse 2SUSP is applied to the sustaining electrode lines Z. The two-step sustaining pulses 2SUSP and −SUSP have a self-erasing level SEL and a sustaining level SUSL. The pixel cells 1 having a video data of "0" are turned off at the first rising edges of the two-step sustaining pulses 2SUSP and –2SUSP. In other words, since the pixel cells 1 having a video data of "0" has not generated the address discharge, only a self-erasure discharge is generated at the first rising edges of the two-step sustaining pulses 2SUSP and –SUSP. On the other hand, the pixel cells 1 generating the address discharge, that is, the pixel cells having a video data of "1" are sustaining-discharged at the second rising edges of the two step sustaining pulses 2SUSP and –2SUSP because a voltage within the discharge space have been raised by a voltage level able to cause the sustaining discharge. As a result, if the two-step sustaining pulses 2SUSP and –2SUSP are applied, then the pixel cells 1 having a video data of "1" generates a sustaining discharge to be luminous, whereas the pixel cells 1 having a video data of "0" stop a luminescence by the erasure discharge. The luminescence level has the highest value during the sustaining discharge. On the other hand, since the pixel cells 1 are luminous at a slight level during the writing discharge, the address discharge and the self-erasure discharge, it is not almost sensed visually.

Figure 1:
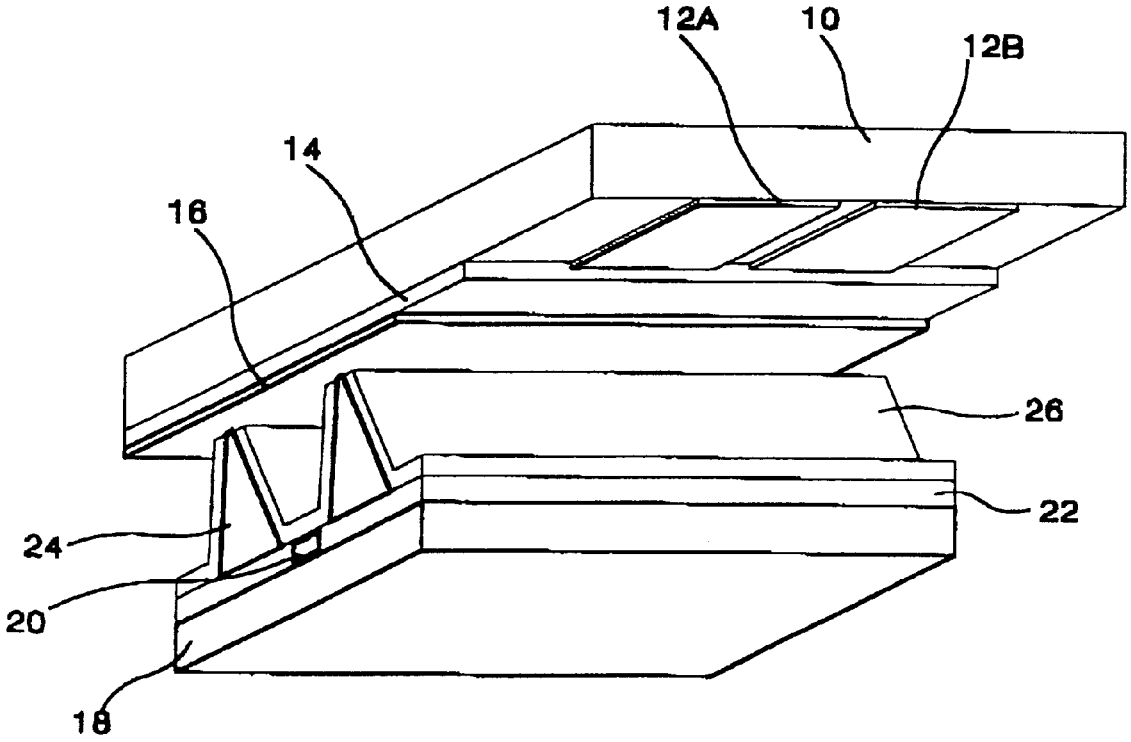
FIG. 1 PRIOR ART
FIG. 1 is a perspective view showing the structure of a pixel cell of the conventional AC-system PDP.
Figure 2:
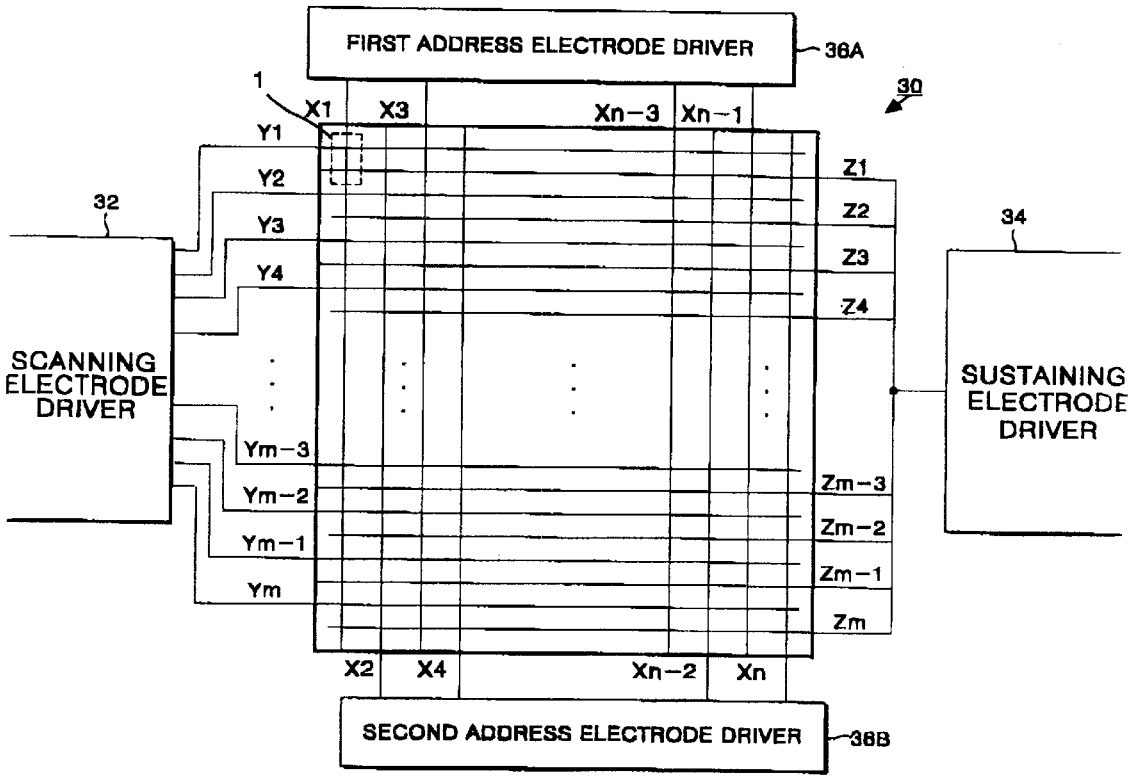
FIG. 2 PRIOR ART
FIG. 2 is a plan view showing an arrangement between the pixel cells and electrode lines of the AC-system PDP in FIG. 1.
Figure 3:
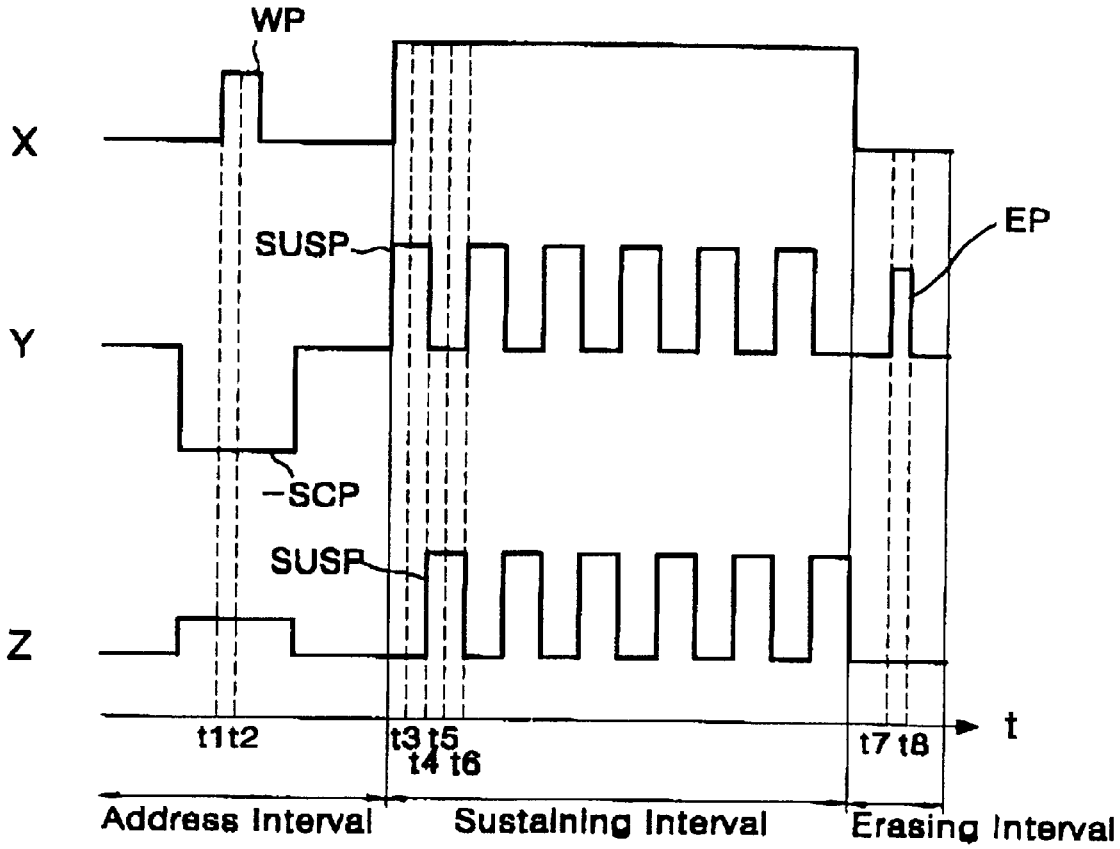
FIG. 3 PRIOR ART
FIG. 3 is drive waveform diagrams for explaining the conventional AC-system PDP.
Figure 4:
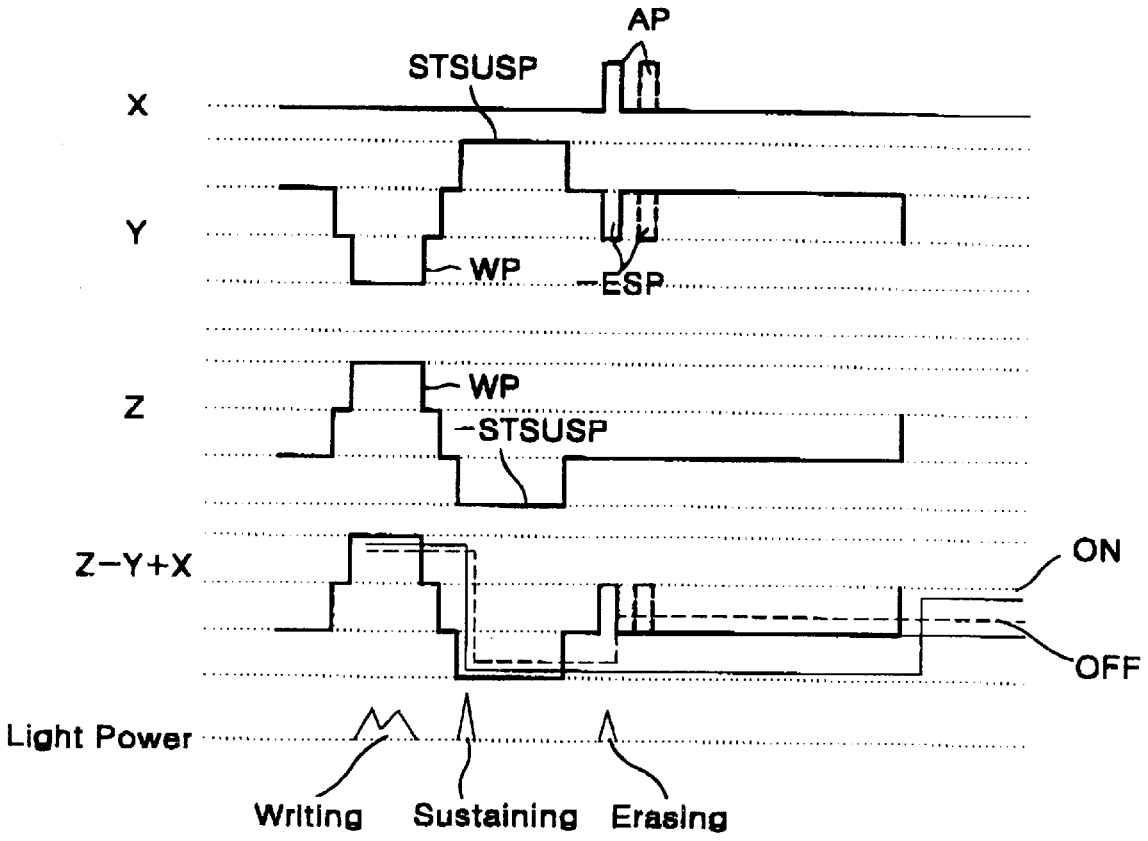
FIG. 4 PRIOR ART
FIG. 4 is drive waveform diagrams showing a PDP driving method employing the conventional selective erasing method.

As described above, the PDP driving method according to the present invention applies an address pulse or an erasure pulse having a pulse width less than 1 $\mu$s so as to select pixel cells, thereby improving a data processing speed in comparison to the selective writing method selecting pixel cells using a pulse width more than 3 $\mu$s. Accordingly, the PDP driving method is capable of driving a PDP at a high speed in such a manner to be suitable for a high resolution. Also, the PDP driving method according to the present invention minimizes a luminescence at a non-display interval to lower the black brightness, thereby improving the contrast. When FIG. 4 is compared with FIG. 5, the PDP driving method using the conventional selective erasing system generates a discharge accompanying the luminescence within pixel cells included in a partial area displaying the black level in a single frame by the number of sub-fields×(the frequency of writing discharge+stabilization-sustaining discharge+erasure discharge), whereas the PDP driving method according to the present invention generates a discharge within a single frame by the number of sub-fields×(the frequency of writing discharge+self-erasure discharge). Accordingly, the PDP driving method according to the present invention can lower the brightness for the black level because the stabilization-sustaining discharge being luminous at a high brightness is eliminated. Accordingly, in the PDP driving method according to the present invention, a difference between the black level and the white peak becomes large, thereby improving the contrast.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel having pixel cells provided with intersections among scanning electrodes, sustaining electrodes and address electrodes arranged in a matrix pattern, said method comprising:

providing a writing discharge for pixel cells at arbitrarily selected lines in the pixel cells;

providing an address discharge for specified pixel cells in the writing-discharged pixel cells to select the specified pixels; and sustaining a discharge of the specified pixel cells by a sustaining discharge pulse, wherein a discharge of the pixel cells except for the specified pixel cells are erased by the sustaining discharge pulse.

2. The method as claimed in claim 1, wherein said sustaining discharge pulse is a two-step pulse.

3. The method as claimed in claim 2, wherein said two-step pulse has a self-erasable level and a sustainable level.

4. The method as claimed in claim 3, wherein a voltage within the specified pixel cells is controlled into the sustainable level by causing the address discharge.

5. The method as claimed in claim 3, wherein a voltage within pixel cells in which the address discharge is not generated is controlled into the self-erasable level.

6. The method as claimed in claim 1, wherein a scanning pulse applied to the scanning electrode during the address discharge has a pulse width less than 1 $\mu$s.

7. The method as claimed in claim 1, wherein a voltage difference between the scanning electrode and the sustaining electrode for sustaining the discharge of the specified pixel cells is set to be higher than a voltage difference for erasing a discharge of the pixel cells except for the specified pixel cells.

8. The method as claimed in claim 7, wherein a two-step pulse having a phase contrary to each other is applied to the address electrode and the scanning electrode, thereby sustaining a discharge of the specified pixel cells and self-erasing a discharge of the pixel cells except for the specified pixel cells.

9. A method of driving a plasma display panel having pixel cells provided with intersections among scanning electrodes, sustaining electrodes and address electrodes arranged in a matrix pattern, said method comprising:

providing a writing discharge for pixel cells at arbitrarily selected lines in the pixel cells;

providing an address discharge for specified pixel cells in the writing-discharged pixel cells to select the specified pixels; and sustaining a discharge of the specified pixel cells by a sustaining discharge pulse and self-erasing a discharge of the pixel cells except for the specified pixel cells, wherein said sustaining discharge pulse is a two-step pulse, and said two-step pulse has a self-erasable level and a sustainable level.

10. The method as claimed in claim 9, wherein a voltage within the specified pixel cells is controlled into the sustainable level by causing the address discharge.

11. The method as claimed in claim 9, wherein a voltage within pixel cells in which the address discharge is not generated in controlled into the self-erasable level.

* * * * *